United States Patent [19]

Sheldon, Jr.

[11] 4,138,113

[45] Feb. 6, 1979

[54] DART FLETCHING ASSEMBLY

[75] Inventor: Walter M. Sheldon, Jr., Deerfield, Ill.

[73] Assignee: Fansteel Inc., North Chicago, Ill.

[21] Appl. No.: 804,947

[22] Filed: Jun. 9, 1977

[51] Int. Cl.[2] ..... A63B 65/02

[52] U.S. Cl. ..... 273/106.5 C; 29/447; 264/DIG. 71; 403/273

[58] Field of Search ..... 273/106.5 R, 106.5 C; 264/230, 342 R, DIG. 71; 339/DIG. 1; 29/447; 403/273; 174/DIG. 8

[56] References Cited

U.S. PATENT DOCUMENTS

| | | | |
|---|---|---|---|
| 467,979 | 2/1892 | Latulip | 29/447 UX |
| 2,863,132 | 12/1958 | Sowa | 174/DIG. 8 UX |
| 3,305,625 | 2/1967 | Ellis | 174/DIG. 8 UX |
| 3,544,672 | 12/1970 | Goda et al. | 264/230 |
| 3,714,316 | 1/1973 | Angeloff | 264/230 |
| 3,990,705 | 11/1976 | Clarke | 273/106.5 C |

FOREIGN PATENT DOCUMENTS

| | | | |
|---|---|---|---|
| 1575252 | 5/1973 | Fed. Rep. of Germany | 403/273 |

OTHER PUBLICATIONS

IBM Technical Disclosure Bulletin, vol. 9, No. 3, 8-1966, pp. 311 & 312, Uberbacher.

*Primary Examiner*—Paul E. Shapiro
*Attorney, Agent, or Firm*—Barnes, Kisselle, Raisch & Choate

[57] ABSTRACT

A novel fletching assembly for darts having an exceptional design to allow darts to be placed in the target in close proximity with a minimum tendency to displace the flights of previously thrown darts, and to cause minimum deflection of other thrown darts is provided by securing the flight assembly by three or more pins with rounded heads and portions of their shanks securing the individual flights, and with the leading end of the pins secured in a hole in the dart fletching body and maintained in close tangential juxtaposition by means of a heat shrinkable tube encasing the cluster of pins from the front end of the dart flights forward onto the outside diameter of the aft end of the dart fletching body.

4 Claims, 5 Drawing Figures

DART FLETCHING ASSEMBLY

BACKGROUND OF THE INVENTION

This invention relates to improved fletching assemblies that can be used on a variety of the state-of-the-art darts, and especially when used in combination with my copending application on a "composite Dart Body," Ser. No. 687,168, filed May 17, 1976, and my copending application, "Composite Filled Dart Body," Ser. No. 724,977, filed Sept. 20, 1976, provides superior darts of substantial improved construction and performance.

State-of-the-art darts are produced in a wide range of shapes, weights and designs, and they are constructed from a wide variety of materials, both metallic and non-metallic. Easily machined materials such as copper-base alloys, particularly various grades of brass, are commonly used for the dart bodies to provide a relatively low cost construction, free machining characteristics, adequate resistance to corrosion from the atmosphere and from human contact, and esthetic appearance. Higher density materials such as sintered tungsten-copper alloys are used in dart bodies of more advanced state-of-the-art darts. These state-of-the-art darts, as well as those of my copending applications cited, include a hardened metal point at the front which engages the target, but is not a feature of this invention except in combination with the improvements stated.

The fletching assembly at the rear of a dart is normally threaded into the dart body but may be joined by brazing as in my copending application, Ser. No. 687,168. Several prior art patents incorporate at least one metal pin which protrudes from the rear end of the fletching adaptor for mounting at least three bodies of folded sheet plastic material or other dart flight material. The pins are generally arranged parallel to each other, with each pin positioned in tangential contact with adjacent pins over part of their length. In some such designs, the ends of the pins are folded to prevent the blades from rotating with respect to the pins. In some other art, the pin may be in the form of a "U" shaped bent pin to secure the dart flights. These state-of-the-art designs are detrimental in that they stop or deflect subsequent darts that may be thrown in contact with the fletching assembly of a previously thrown dart. They also increase the chance of tearing the dart flights. The pins, especially when constructed of high carbon steel, can break under these conditions. An example of a multiple pin fletching adaptor is found in the following patents:

U.S. Pat. No. 3,990,705 — Nov. 9, 1976 Clarke (U.S.A.)

U.S. Pat. No. 3,995,861 — Dec. 7, 1976 Clarke (U.S.A.)

U.S. Pat. No. 589,629 — Feb. 13, 1945 Sulman (British)

Furthermore, these state-of-the-art dart pin-type fletching assemblies hold the dart flights at only one point where the pins pinch against the flights; thus, they do not provide positive and secure location of the dart flights; also, the length of the pins often vary in the assembly which adversely affects their balance.

SUMMARY OF THE INVENTION

This invention provides substantial improvements in fletching assemblies for darts. These improved assemblies incorporate rounded head pins of equal length at the rear of the dart to hold pop-off type flights. These improvements include:

(1) Pins that spread open to allow contact of the pins at two positions on the dart flights, i.e., where the rounded heads contact the flights, and further forward where the shanks of the pins converge against the flights.

(2) The convergence of the shanks of the pins is provided by seating their lead end against a stop in a recess in the aft end of a dart fletching assembly body, and further by circumferential compression provided by a heat shrinkable tube that overlaps the aft portion of the dart fletching assembly body and the rearwardly extending portion of the shanks of the pins up to the position where they abut the forward tips of the dart flights.

(3) These features in combination hold the dart flights more securely and uniformly, permits precise and stable placement of the dart flights, reduces pin breakage, prevents wobbling of the flights in the thrown darts, and improves their balance, thus substantially increasing their thrown accuracy and uniformity from dart-to-dart.

(4) These combined features minimize the tendency for the flights to tear or wear when they are inserted between the rounded head pins.

(5) The heat shrinkable tubing is fitted over a reduced diameter with a detent (undercut) in the OD of the aft of the dart fletching assembly body, which feature reduces the strain and breakage of the pins for nearly their entire length.

(6) The heat shrinkable tubing also tends to prevent penetration of subsequently thrown darts into the fletching assembly body.

(7) The improved fletching assembly of this invention is constructed of low density materials to reduce its weight to a minimum. The fletching assembly body can also be of minimum length, and be partially hollow, if desired, to further reduce its weight.

(8) Various length fletching assemblies to suit player's preferences, while keeping the total assembly weight to a minimum, is achieved by keeping the fletching assembly body to a minimum length and by using a hollow interior, while using rounded head pins and heat shrinkable tubing of desired lengths to achieve the desired overall length of the entire fletching assembly.

(9) The threads or other means for attachment of the fletching assembly to the dart body can be sealed with a "Nyloc" type of plastic applied to the threads; or the threads can be dipped in a thermosetting plastic or other suitable potting compound to lock then in place. This feature provides a firm seating of the fletching assembly to the dart body, preventing them from unscrewing, and making them act as an integral unit dart.

(10) All of the above improvements in combination improve and minimize deflection characteristics of subsequently thrown darts that impinge on previously thrown darts, and provide rugged and accurate darts of superior uniformity and scoring capabilities.

By contrast, prior state-of-the-art dart fletching assemblies with square end pins or "U" shaped pins can cause subsequently thrown darts to be stopped and dropped to the floor when they encounter such ends of previously thrown darts.

Other objects and features of the invention will be apparent in the following description in which details are provided to enable a person skilled in the art to utilize the invention, all in connection with the best mode presently contemplated for the practice of the invention.

BRIEF DESCRIPTION OF THE INVENTION

An example of the fletching assembly according to this invention will now be described with reference to the accompanying drawings:

FIG. 1, a side view of a complete dart assembly including the novel fletching assembly.

FIG. 2, a longitudinal sectional view of the fletching assembly components.

FIG. 3, a sectional view of the pins used in the fletching assembly taken on line 3—3 of FIG. 2.

FIG. 4, a sectional view on line 4—4 of FIG. 2.

FIG. 5, an end view at the aft of the dart fletching assembly with the flights installed.

DETAILED DESCRIPTION OF THE INVENTION

Figure 1:
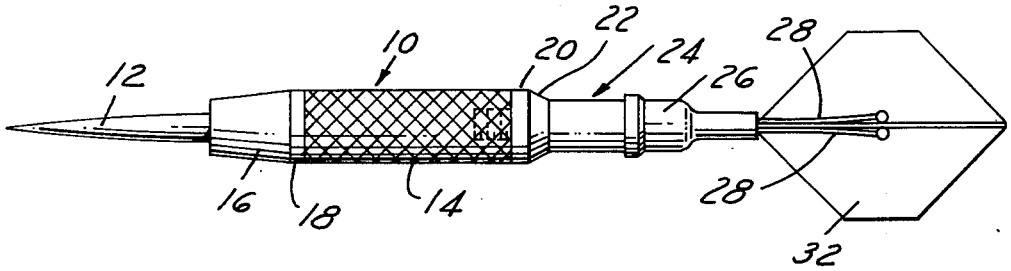

FIG. 1 shows a complete dart 10 having a leading point 12 of a hardened material such as a high carbon steel (Grade 1065 or higher carbon content steel), or a martensitic stainless steel such as Grade 420 embedded in the main dart knurled body 14 by techniques such as press fitting or by potting with materials such as a pressure sensitive anaerobic, i.e., methacrylic ester as a self-hardened liquid, or other suitable high strength adhesives. The hardened point 12 engages in a socket in the axis of the lead end 16 of dart body 14, which is tapered forwardly to the point, and optionally may have a flat section 18 contiguous with the knurled body.

The improved fletching assembly of this invention is comprised of a straight section 20 and a tapered section 22 leading to a reduced diameter 24 into which three or more pins 28 with rounded heads 30 are embedded in a cylindrical hole 38 (shown in FIGS. 2 and 3) in the aft of body 24 and secured into snug tangential contact by a boot or sleeve of a heat shrinkable tube material 26. The dart flights 32 can have various shapes depending on player preference, and the number of such flights will be equal to the number of pins 28.

Figure 2:
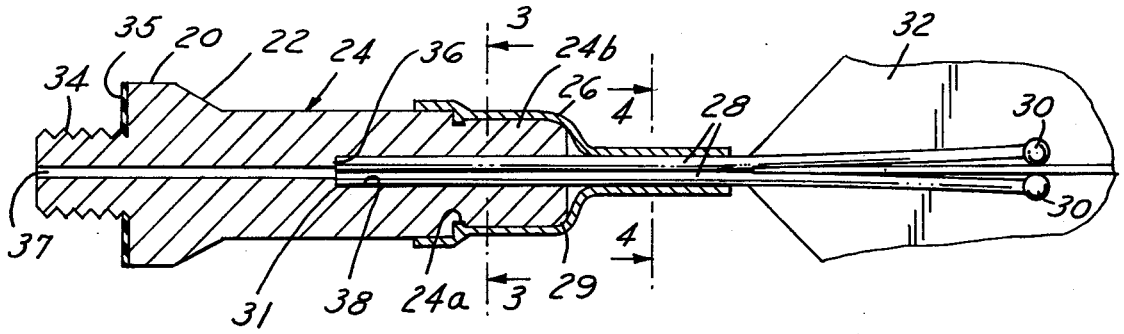

FIG. 2 shows additional details of the construction of the fletching assembly. The lead end of the member 24 has a threaded section 34 that mates with dart body 14. A gasket or lock washer 35 constructed from a soft metal, rubber, or suitable plastic may be used to further secure fletching assembly threads to dart body 14. Optionally, threads 34 may be sealed or dipped with a plastic such as "Nyloc" or other suitable material that will harden and seal threads 34 after assembly into dart body 14. The major portion of body 24 may be solid in cross-section in one embodiment, or it may be hollowed partially or entirely by machining to reduce weight in other embodiments.

Figure 3:
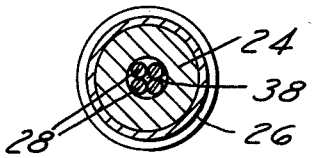

In the embodiment shown in FIG. 2, body 24 is drilled or bored at 38 from the aft end forwardly to stop 36. To further reduce weight, one or more smaller diameter holes 37 may be drilled from stop 36 forwardly to the end of threaded section 34, if desired. The diameter of hole or holes 37 must, of course, be smaller than the diameter of the pins 28. Pins 28 number three or more, depending upon the number of dart flights preferred. In the example, four pins are shown. In assembling the fletching assembly, pins 28 are slipped through a heat shrinkable tube 26 and installed in hole 28 in body 24, also shown as viewed in FIG. 3, until the forward tip 31, shown in FIG. 2, of the pins abuts against stop 36. The inserted pins are shown in position in hole 38. Desirably, the pins should be in uniform and snug tangential contact in the dart fletching body as shown in FIG. 3. For example, if four dart flights are preferred, four pins 28, each about 0.040 inch diameter would be inserted in hole 38 of about 0.100 inch diameter (where 0.0966 inch diameter would provide tightest packing with zero clearance). The pins have a rounded head 30, which may be spherical, hemispherical, oval or other suitable rounded shape. The diameter of the rounded heads 30 is not critical, but diameters of about 1.2 to 2.0 times that of pin shank 28 have performed well.

Figure 5:
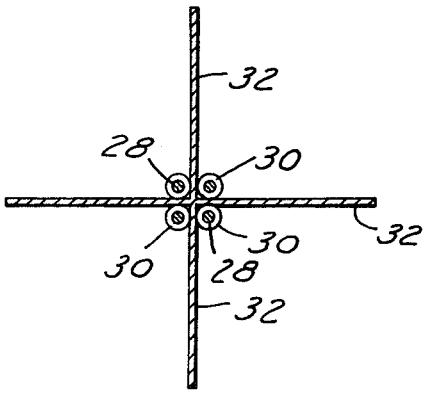
Figure 4:
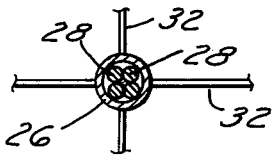

The cross-section in FIG. 4 shows the relationship of the heat-shrinkable tube 26 to the nested pins 28. The aft view showing the rounded ends 30 of four pins 28 and four dart flights 32 secured by these pins is shown in FIG. 5.

The material of construction for the fletching assembly body 24 can be selected from a wide choice of materials, although commonly a lightweight material such as aluminum, wood, or plastic is utilized. The pins 28 desirably are of a material with a modulus of elasticity on the order of about 28,000,000 to 30,000,000 psi, such as a high carbon steel or a more corrosion resistant material such as stainless steel. However, the pins must also have adequate toughness to allow limited deflection without breakage. The boot or heat shrinkable tube material 26 can be selected from a number of elastic materials such as rubber, polyethylenes, polyurethanes, and other suitable materials. It is generally desirable to reduce the weight of the fletching assembly to the minimum, while maintaining a capability to vary the overall length of the assembly. In this invention, the overall length of the assembly. In this invention, the overall length of the threads 34 is typically about 3/16", providing about four threads; and the remainder of the combined overall length of the fletching assembly body shoulder 20, taper 22, body 24, detent 24*a*, straight section 24*b*, and rear chamfer 29 are kept to a minimum, generally 17/32 to 1⅛" length, and about ¾" typically.

EXAMPLE 1

A brass body approximately 2" in length was machined to the dart body configuration 14 shown in FIG. 1. The exterior of the body was diamond knurled for gripping purposes along nearly the entire length of the major outside diameter. A Grade 420 martensite stainless steel point 12, which had been previously hardened, was inserted in a hole along the axis in the front of the brass body, and was secured with a pressure sensitive anaerobic adhesive.

The rear of brass body 14 was drilled and tapped to match the male thread 34 on aluminum body 24. The rear end of the fletching assembly body 24 was machined to produce an axial hole 38 to depth 36, a reduced section 24*b*, an undercut groove 24*a*, and a chamfer 29. A heat shrinkable plastic tube 26 was slid over the chamfer 29 and reduced section 24*b*, and beyond the undercut detent groove 24*a* a short distance onto straight body section 24. Four pins 28 with elliptical rounded heads 30 and each measuring about 1½" total length were inserted through heat shrinkable tube 26 and abutted to stop 36 in body 24. The pins were constructed from 0.040" diameter Type 304 stainless steel with an upset elliptical head 30. Then threaded end 34 was coated with "Nyloc" and assembled to body 14 and secured snugly. Optionally, a rubber gasket 35 can be abutted against shoulder 20 of body 24 before assembling threads 34 into dart body 14. Plastic flights 32 were then inserted to complete the dart assembly.

Playing performance of these darts was found to be excellent in comparison to other state-of-the-art darts.

The above example serves to illustrate a type of dart fletching assembly covered by this invention, but is not limiting and the improved fletching assemblies are further defined in the claims.

I claim:

1. A dart flight assembly of the type to be secured the aft end of a dart body which comprises:

(a) a fletching body section having means to secure the fore-end of the section to the aft end of a dart body, (b) said section having an axial recess in the aft end thereof terminating at a defined shoulder at a blind end, (c) a plurality of at least three pins having a high modulus of elasticity each having a fore-end inserted in said section recess against said shoulder and each having an aft end extending from said recess, said pins being in close contact with each other, (d) a heat shrinkable tube overlying a portion of said body section and a portion of said pins to hold said pins in close contact with each other, and (e) a fletching assembly having a plurality of blades held at the roots of the blades between said pins.

2. A dart flight assembly as defined in claim 1 in which said body section has an annular recess in the outer surface thereof and said heat shrinkable tube is locked into said recess.

3. A dart flight assembly as defined in claim 1 in which the aft end of said pins have a rounded protuberance thereon to contact the blades of said fletching assembly adjacent the roots of said blade

4. A dart flight assembly as defined in claim 1 in which the fletching body section has a fore-end with a diameter substantially equal to a dart body, a first reduced main section, and a second further reduced aft end, there being a groove formed between the reduced sections to receive a portion of the heat shrinkable tube to lock the tube on to the fletching body section.

* * * * *